United States Patent [19]

Dannatt

[11] Patent Number: 5,041,953

[45] Date of Patent: Aug. 20, 1991

[54] LIGHT FIXTURE

[76] Inventor: Norbert H. W. Dannatt, 4311 Meadowview Ct., Colorado Springs, Colo. 80918

[21] Appl. No.: 566,090

[22] Filed: Aug. 10, 1990

[51] Int. Cl.[5] ..... F21S 3/00

[52] U.S. Cl. ..... 362/219; 362/249; 362/226; 439/239

[58] Field of Search ..... 362/219, 226, 227, 249, 362/223, 238; 439/742, 240–242, 239, 226

[56] References Cited

U.S. PATENT DOCUMENTS

| | | | |
|---|---|---|---|
| 2,298,824 | 10/1942 | Darley | 173/337 |
| 4,158,221 | 6/1979 | Agabekov | 362/219 |
| 4,521,838 | 6/1985 | Agabekov | 362/219 |
| 4,654,765 | 3/1987 | Laidman | 362/238 |
| 4,723,199 | 2/1988 | Freed et al. | 362/219 |
| 4,858,088 | 8/1989 | Agabekov | 362/249 |
| 4,874,320 | 10/1989 | Freed et al. | 439/239 |

FOREIGN PATENT DOCUMENTS

| | | | |
|---|---|---|---|
| 8706326 | 10/1987 | Fed. Rep. of Germany . | |
| 935796 | 6/1948 | France | 362/219 |
| 2451542 | 10/1980 | France | 362/249 |

*Primary Examiner*—James C. Yeung
*Attorney, Agent, or Firm*—Linda Flewellen Gould

[57] ABSTRACT

A light fixture suitable for supporting and illuminating a parallel string of lamps with contacts on opposite ends permits light to be emitted from those lamps over a wide area, with little obstruction by the leaf fixture itself. The fixture may comprise a flat support, two conductive strips attached to the lower side of the flat support, and a plurality of U-shaped conductive conductors attached to the upper side of the flat support. The conductive strips are positioned parallel to the flat support, and parallel to each other, with an area of separation between them. A plurality of first U-shaped conductive connectors are attached directly above one of the conductive strips, in contact with it, while a plurality of second U-shaped conductive connectors are attached directly above the other conductive strip, in contact with it. Each U-shaped connector is fashioned so that lateral elements of the U-shaped connector bend from the apex of the U-shaped connector to form an angle of between 0 to 90 degrees with the flat support, permitting the lamps held between the lateral elements to be held along a common axis parallel to the flat support.

2 Claims, 1 Drawing Sheet

LIGHT FIXTURE

BACKGROUND OF THE INVENTION

1. Technical Field

This invention pertains to light fixtures for a plurality of lamps or lamp attachments having two contacts at opposite ends.

2. Background Art

Lamps or lamp attachments which have two contacts at opposite ends, including festune bulbs, tubular lamps, lamp attachments directing current to standard bulbs from opposite ends, and lamp attachments directing light from bulbs in a spotlight or other particular configuration, shall all be referred to herein as "lamps". A number of fixtures are known in the prior art for supplying light by means of a parallel string of lamps. These fixtures are often used to provide either direct or indirect illumination to highlight displays, stair rails and steps, and signs. Lamps supported in a parallel configuration are useful in any linear application that does not require a great deal of scalloping.

Each fixture supporting a parallel string of lamps must accommodate two separated conductive paths, each being connected to the contacts at opposite ends of the bulb, while permitting the bulbs to be lined up so that all of the contacts are in a common axis. To satisfy this requirement, French patent 2451-542 teaches a zig-zag pattern for the conductive paths, running beneath a flat support Alternatively, U.S. Pat. No. 2,298,824 to Darley describes a lamp socket for florescent bulbs, requiring the lamps to be held in an overlapping relationship. Still other designs have utilized side-by-side conductive paths, with complex projecting parts from each conductive path to the opposite contacts on each lamp.

To eliminate the complexity of such flat light fixtures, while providing illumination for a series of parallel lamps, a number of fixtures have been created. For example, U.S. Pat. Nos. 158,221, 4,521,838, and 4,858,088, all to Agabekov, describe light fixtures based on separate conductive paths carried on perpendicular flanges. Similarly, U.S. Pat. No. 4,723,199 to Freed et al. and German Patent No. 87/06326 disclose light fixtures in which separated conductive paths are supported on the back sides of angled flanges. In these angled fixtures, lamps may be held in place by simple brackets, enabling these fixtures to be manufactured more economically and easily than possible with the complicated attachments o wiring required for flat light fixtures known in the prior art.

There are some disadvantages to the angled light fixtures used for supporting a series of lamps. For example, light emitted from a perpendicular fixture necessarily emits direct light to brighten an area of approximately 170 degrees. In contrast, support of a series of lamps on a flat fixture permits light to be emitted over approximately 260 degrees, with only the area directly behind the flat fixture shielded from light. Furthermore, support of a string of lamps by an angled fixture tends to contain heat generated by the lamps, directing unwanted heat to a wall or other support to which the fixture is attached. This contained heat may have detrimental effects, including a reduction in the life of the lamps. Thus, although the light fixtures known in the prior art have particular advantages and purposes, there is a need for a fixture to support a parallel series of lamps, which can be simply constructed, and which will allow light and heat to be disseminated over a larger area than possible with the use of an angled fixture.

DISCLOSURE OF THE INVENTION

Summary of the Invention

An object of this invention is to provide an economical and simply manufactured light fixture, suitable for supporting and illuminating a parallel string of lamps with contacts on opposite ends.

Another object of this invention is to provide a light fixture for a parallel string of lamps, which does not trap heat emitted by the lamps.

Yet another object of this invention is to provide a light fixture that will not unduly block light being emitted by a parallel string of lamps.

The light fixture claimed herein holds and illuminates a parallel string of lamps, so that light is emitted over a wide radius, blocked only by a flat support member of a width which may be no greater than the sum of the widths of two conductive strips and an area of separation between them. By supporting the lamps on a flat support, heat generated by the lamps may dissipate over the same radius through which light is emitted, preventing heat build-up and resulting damage to adjacent structures. The light fixture is easily constructed, utilizing simply manufactured components and straight conductive strips.

The light fixture claimed herein comprises a flat support, two parallel conductive strips, and two sets of U-shaped conductive connectors. The elongated flat support is formed of insulating material. The width of the flat support does not need to be greater than the sum of the widths of the conductive strips and a separating area between them, permitting light to be emitted over a wide radius.

Attached to the lower side of the flat support, in parallel paths which are parallel to the flat support and separated from each other, are two conductive strips. U-shaped conductive connectors are attached to the upper side of the flat support. Each U-shaped connector is held against the upper side of the flat support by a conductive pin which extends through the U-shaped connector, and through the flat support, to contact one of the conductive strips o the lower side of the flat support. The U-shaped connectors are positioned so that each U-shaped connector contacting one of the conductive strips is located directly between two U-shaped connectors contacting the other conductive strip. The U-shaped connectors are spaced on the flat support so that a lamp may be held tightly between each U-shaped connector and an adjacent U-shaped connector.

Each U-shaped connector comprises two lateral elements. The lateral elements are adapted to releasibly hold one of the contacts of a lamp. This may be accomplished by forming a hole in each lateral element, of a size sufficient to receive and clasp a contact of a lamp. The lateral elements may be moved inward toward one another, permitting lamps to be pushed into or removed from a position adjacent to each U-shaped connector, but will resume their original position to hold the lamps in place when no external pressure is exerted on the lamps.

The U-shaped connectors are fashioned so that, when the apex of the U-shaped connector is attached to the upper side of the flat support, the lateral elements of that U-shaped connector form an angle between 0 degrees and 90 degrees with the upper side of the flat support. In this manner, each U-shaped connector effectively bends from its ape held against the flat support directly above one of the conductive strips, to a position above a common axis directly above an area separating the two conductive strips. Lamps held in place by the lateral elements are thus positioned in a parallel path along that common axis.

The novel features that are considered characteristic of the invention are set forth with particularity in the claims. The invention itself, both as to its construction and its method of operation, together with additional objects and advantages thereof, will best be understood from the description of specific embodiments which follows, when read in conjunction with the accompanying drawings.

DETAILED DESCRIPTION OF THE PREFERRED EMBODIMENT

Figures 1, 2, 3:
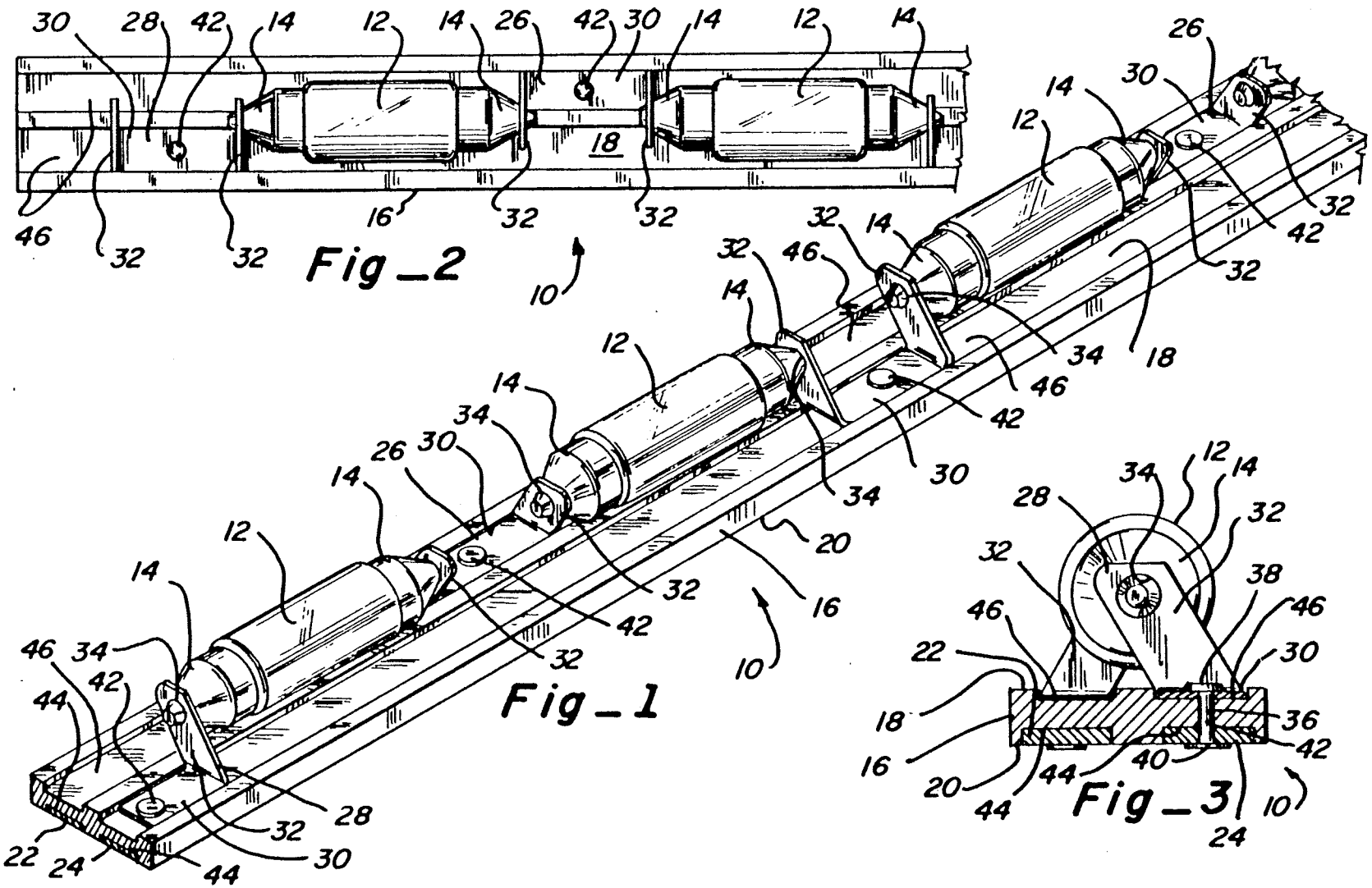
FIG. 1 is a perspective view of a light fixture, according to the present invention.
FIG. 2 is a top view of a light fixture, according to the present invention.
FIG. 3 is a cross-section side view of a light fixture according to the present invention.

The light fixture of the present invention can be better understood by reference to FIG. 1. A light fixture 10 is designed to hold and illuminate a plurality of lamps 12. Each lamp 12 has two contacts 14 at opposite ends of the lamp 12. Thus, each lamp 12 may be a festune bulb, tubular lamp, lamp attachment, or other illuminating member having two contacts at opposite ends.

As shown in FIG. 1, the light fixture 10 comprises a flat support 16, a first conductive strip 22, a second conductive strip 24, at least one first U-shaped conductive connector 26, and at least one second U-shaped conductive connector 28. The flat support 16 is formed of insulating material, such as plastic. The width of the flat support 16 may be advantageously determined by the sum of the widths of the two conductive strips 22, 24, plus an area separating the conductive strips 22, 24. In this manner, the flat support 16 will have a width no larger than necessary, permitting light to be emitted by the lamps 12 throughout an extensive radius substantially unhindered by the flat support 16.

The first conductive strip 22 is attached to the lower side 20 of the flat support 16, so that the strip 22 is parallel to the flat support 16. Similarly, the second conductive strip 24 is attached to the lower side 20, parallel to the flat support 16, parallel to the first conductive strip 22, and separated from the first conductive strip 22. Each conductive strip 22, 24 is constructed of conductive material, and may conveniently be formed of brass or other metallic rail. To prevent a short from occurring across the two conductive strips 22 and 24, the lower side 20 of the flat support 16 may be attached to an insulating member (not shown) or covered by insulating material such as adhesive tape (not shown).

In an embodiment of this invention shown in FIGS. 1 and 3, two grooves 44 are formed in the lower side 20 of the flat support 16. Each groove is shaped to receive one of the conductive strips 22, 24. In this embodiment, a portion of the insulating material forming the flat support 16 is positioned between the conductive strips 22 and 24. The conductive strips 22, 24 may be positioned flush with the lower side 20 of the flat support 16, may extend beyond the lower side 20, or may be recessed within the grooves 44.

As is best shown in FIG. 2, a plurality of first U-shaped conductive connectors 26 may be attached to the upper side 18 of the flat support 16. These first U-shaped connectors 26 are arranged along the flat support 16 so that the apex 30 of each connector 26 is positioned directly above the first conductive strip 22. Similarly, a plurality of second U-shaped conductive connectors 28 may be attached to the upper side 18 of the flat support 16. Each second U-shaped connector 28 is positioned so that the apex 30 of that connector 28 is positioned directly above the second conductive strip 24.

Each U-shaped conductive connector 26, 28 may be advantageously formed out of brass or other metal, most conveniently by stamping and molding each connector. Similarly, conductive pins 42 constructed of conductive material are used to attach the U-shaped conductive connectors 26, 28 to the flat support 16. As shown in FIG. 3, each conductive pin 42 may simply comprise an elongated bar 36, a first head 38, and a second head 40. The first head 38 is shaped to hold the apex 30 of the applicable U-shaped connector 26,28, against the upper side 18 of the flat support 16. The elongated bar 36 extends from the first head 38 through the U-shaped connector 26,28 into and through the flat support 16, emerging through the lower side 20 of the flat support 16, and through the applicable conductive strip 22 or 24. The length of the elongated bar 36 is equal to the sum of the depths of the U-shaped connector 26,28, the flat support 16, and the conductive strip 22,24. Thus, the second head 40 is positioned against the applicable conductive strip 22,24. Other designs of the conductive pins 42 are possible, each constructed of conductive material to permit the conductive pins 42 to act as a method of attaching the U-shaped connectors 26,28 and a vehicle of contact between each U-shaped connector 26,28 and the conductive strip 22,24 directly below that connector 26,28.

Each U-shaped connector 26,28 may be securely held in place by situating the apex 30 of that connector 26,28 in a groove 46 formed in the upper side 18 of the flat support 16, as is shown in FIG. 2. Dual grooves 46 may be formed in the upper side 18 of the flat support 16, each groove 46 directly above one of the conductive strips 22,24. In this manner, the apex 30 of each connector 26,28 may be snugly held in place within one of the grooves 46, to prevent that U-shaped connector 26,28 from being rotated about its apex 30.

The U-shaped connectors 26,28 are positioned so that each first U-shaped connector 26 is located directly between two second U-shaped connectors 28. Similarly, each second U-shaped connector 28 is located directly between two first U-shaped connectors 26. The U-shaped connectors 26,28 are spaced on the flat support 16 so that a lamp 12 may be held tightly between a first U-shaped connector 26 and an adjacent second U-shaped connector 28.

Each U-shaped connector 26,28 comprises two lateral elements 32, as is most clearly shown in FIG. 1. Each lateral element 32 is adapted to releasibly hold one of the contacts 14 of a lamp 12. This may be accomplished by forming a hole 34 in each lateral element 32, of a size sufficient to receive and hold the contact 14 of a lamp 12 to be positioned adjacent to that lateral element 32. Each lateral element 32 may be advantageously constructed of material sufficiently flexible to permit the lateral element 32 to be moved inward, toward the apex 30 of the U-shaped connector 26,28, when pressure is exerted on a lamp 12 to push the lamp 12 into a position adjacent to the lateral element 32, or to remove the lamp 12 from such a position. Each lateral element 32 is sufficiently rigid to hold a lamp 12 in place, between that lateral element 32 and the lateral element 32 of an adjacent U-shaped connector 26,28, while no external force is applied to the lamp 12.

Each first U-shaped connector 26 is spaced a distance away from an adjacent second U-shaped connector 28, sufficient to permit each contact 14 of the lamp 12 to be held by the adjacent lateral elements 32 of those U-shaped connectors 26,28.

Each U-shaped connector 26,28 is shaped so that, when the apex 30 of that connector 26,28 is attached to the upper side 18 of the flat support 16, the lateral elements 32 of that U-shaped connector 26,28 form an acute angle with the upper side 18 of the flat support 16. Thus, each U-shaped connector 26,28 bends from its apex 30 held against the flat support 16 directly above one of the conductive strips 22,24, to a position above a common axis directly above an area separating the two conductive strips 22,24. Each lamp 12 held in place between a lateral element 32 of a first U-shaped connector 26 and an adjacent lateral element 32 of a second U-shaped connector 28 is thus positioned in a parallel path along that common axis.

The invention has been described in detail with particular reference to preferred embodiments thereof. As will be apparent to those skilled in the art in the light of the accompanying disclosure, many alterations, substitutions, modifications, and variations are possible in the practice of the invention without departing from the spirit and scope of the invention.

I claim:

1. A light fixture, for holding a plurality of lamps, each lamp having two contacts at opposite ends, comprising:

a. an elongated flat support formed of insulating material having an upper side and a lower side, b. a first conductive strip attached to the lower side of the flat support, parallel to the flat support.

c. a second conductive strip attached to the lower side of the flat support, parallel to the flat support, parallel to the first conductive strip, and separated from the first conductive strip, d. at least one first U-shaped conductive connector, attached to the upper side of the flat support by a conductive pin which extends through the flat support to contact the first conductive strip, each of which first U-shaped connectors comprises an apex and two lateral elements, each lateral element adapted to releasibly hold one of the contacts of a lamp, and e. at least one second U-shaped conductive connector, attached to the upper side of the flat support by a conductive pin which extends through the flat support to contact the second conductive strip, each of which second U-shaped connectors comprises an apex and two lateral elements, each lateral element adapted to releasibly hold one of the contacts of a lamp, f. wherein the first U-shaped connectors and the second U-shaped connectors are alternately attached to the flat support, g. wherein said lateral element of each U-shaped connector forms an acute angle with the upper side of the flat support, to hold the lamps along a common axis parallel to the flat support, and h. wherein the upper side of the flat support has a groove formed therein extending directly above the first conductive strip, said groove being of a shape suitable to receive the apex of at least one first U-shaped connector.

2. A light fixture for holding a plurality of lamps, each lamp having two contacts at opposite ends, comprising:

a. an elongated flat support formed of insulating material having an upper side and a lower side, b. a first conductive strip attached to the lower side of the flat support, parallel to the flat support, c. a second conductive strip attached to the lower side of the flat support, parallel to the flat support, parallel to the first conductive strip, and separated from the first conductive strip, d. at least one first U-shaped conductive connector, attached to the upper side of the flat support by a conductive pin which extends through the flat support to contact the first conductive strip, each of which first U-shaped connectors comprises an apex and two lateral elements, each lateral element adapted to releasibly hold one of the contacts of a lamp, and e. at least one second U-shaped conductive connector, attached to the upper side of the flat support by a conductive pin which extends through the flat support to contact the second conductive strip, each of which second U-shaped connectors comprises an apex and two lateral elements, each lateral element adapted to releasibly hold one of the contacts of a lamp, f. wherein the first U-shaped connectors and the second U-shaped connectors are alternately attached to the flat support.

g. wherein each lateral element of each U-shaped connector forms an acute angle with the upper side of the flat support, to hold the lamps along a common axis parallel to the flat support, and h. wherein the upper side of the flat support has a groove formed therein extending directly above the second conductive strip, said goove being of a shape suitable to receive the apex of at least one second U-shaped connector.

* * * * *